United States Patent [19]

Izumiya et al.

[11] Patent Number: 4,731,561

[45] Date of Patent: Mar. 15, 1988

[54] CERAMIC ENVELOPE DEVICE FOR HIGH-PRESSURE DISCHARGE LAMP

[75] Inventors: Hirotsugu Izumiya, Nagoya; Takehiro Kajihara, Komaki; Senji Atsumi, Kakamigahara, all of Japan

[73] Assignee: NGK Insulators, Ltd., Japan

[21] Appl. No.: 799,836

[22] Filed: Nov. 20, 1985

[30] Foreign Application Priority Data

Dec. 17, 1984 [JP] Japan ..... 59-191194[U]
May 20, 1985 [JP] Japan ..... 60-74771[U]

[51] Int. Cl.[4] ..... H01J 61/30; H01J 61/36

[52] U.S. Cl. ..... 313/624; 313/625; 313/634

[58] Field of Search ..... 313/624, 625, 623, 635, 313/634

[56] References Cited

U.S. PATENT DOCUMENTS 3,892,993 7/1975 Timmermans ..... 313/623 X
4,155,757 5/1979 Hing .
4,155,758 5/1979 Evans et al. .
4,507,584 3/1985 Coaton et al. ..... 313/623 X
4,539,511 9/1985 Denbigh et al. ..... 313/634 X
4,585,972 4/1986 Hing ..... 313/624 X

FOREIGN PATENT DOCUMENTS 0000840 1/1982 Japan ..... 313/635

*Primary Examiner*—Palmer C. DeMeo
*Attorney, Agent, or Firm*—Parkhurst & Oliff

[57] ABSTRACT

A ceramic envelope device for a high-pressure metal-vapor discharge lamp, including a translucent ceramic tube, a pair of electrically conducting end caps closing opposite ends of the ceramic tube, and a pair of opposed discharge electrodes each of which is supported at its one end by the corresponding end cap such that the other end of the electrode protrudes from the inner surface of the corresponding end cap in a longitudinally inward direction of the ceramic tube. Each of the end caps is covered at its inner surface with an electrical insulator. The electrical insulator has a protruding portion surrounding a part of the corresponding electrode which protrudes from a radially central portion of the inner surface of the corresponding end cap. The surrounded part of the corresponding electrode is radially spaced from the protruding portion (the electrical insulator).

12 Claims, 5 Drawing Figures

CERAMIC ENVELOPE DEVICE FOR HIGH-PRESSURE DISCHARGE LAMP

BACKGROUND OF THE INVENTION

1. Field of the Art

The present invention relates in general to a ceramic envelope device for use in a high-pressure discharge lamp (hereinafter referred to as "HID lamp"; "HID" representing High Intensity Discharge), and more particularly to electrically conducting end caps or closure discs which close the opposite ends of a translucent ceramic tube which cooperates with the end caps to form a gas-tight envelope incorporated in a HID lamp.

2. Related Art Statement

In the art of such HID lamps using a translucent ceramic tube, a pair of electrically conducting discs are known as end caps to close the opposite open ends of the translucent ceramic tube. Examples of such closure end caps are illustrated in U.S. Pat. Nos. 4,155,757 and 4,155,758. Such end caps are formed of an electrically conducting cermet obtained by mixing, for example, particles of tungsten with particles of aluminum oxide, and sintering the mixture. These electrically conducting cermet end caps support a pair of tungsten electrodes at their inner surfaces in the interior of the ceramic envelope so that the electrodes protrude from the inner surfaces of the end caps toward each other, i.e., longitudinally inward of the translucent ceramic tube. In the meantime, electrical contact rods or lead rods are connected or fixed to the outer surfaces of the cermet end caps with suitable methods. Electric power is applied to the pair of opposed tungsten electrodes through the contact rods and through the cermet end caps. Such cermet end caps have been advantageously employed, for example, in high-pressure sodium lamps, because they eliminate the need of using expensive metallic niobium. It is further recognized that such cermet end caps have also been used advantageously for so-called metal halide lamps which employ translucent ceramic tubes charged with a suitable metal halide together with mercury and rare gas, because the cermet exhibits relatively high corrosion resistance to metal halides.

However, such a HID lamp with a translucent ceramic tube closed by cermet end caps may suffer a problem generally known as "arc-back" phenomenon wherein an arc will take place between the electrodes and the corresponding cermet end caps, rather than between the opposed electrodes, when the HID lamp is initially turned on. This arc-back phenomenon causes the cermet end caps to crack, thereby causing the translucent ceramic tube to leak. In addition, the "arc-back" phenomenon gives rise to vaporization and scattering of the refractory metal component of the cermet, and consequent deposition thereof on the inner surface of the ceramic tube, which results in blackening of the wall of the translucent ceramic tube, thereby reducing the degree of its luminous flux.

It is also recognized that supersaturated metal halide in the ceramic tube of a metal halide lamp may be condensed at a cold spot in the tube, e.g., at the lower end portion of the ceramic tube disposed vertically when the lamp is used in its upright position, whereby the cermet end caps closing the end portions of the tube are subject to corrosion due to the liquid phase of condensed metal halide which is currently suffering thermal conduction from the heated electrodes. Severe corrosion of the cement end caps may prevent the end caps from supporting the electrodes in their upright posture.

SUMMARY OF THE INVENTION

The present invention, which was made in view of the above-discussed inconveniences experienced in the prior art, has as its principal object the provision of a ceramic envelope device for a high-pressure metal-vapor discharge lamp. The ceramic envelope device avoids the "arc-back" phenomenon between its electrodes and corresponding end caps and also the corrosion of the central portions of the end caps around the fixed ends of the electrodes. The prevention of corrosion of the end caps results in the electrodes being stably supported in position by the end caps for a long period of time.

According to the invention, there is provided a ceramic envelope device for use in a high-pressure discharge lamp comprising a translucent ceramic tube, a pair of electrically conducting end caps closing opposite ends of the ceramic tube, and a pair of opposed discharge electrodes each of which is supported at its one end by corresponding end cap, such that the other end of the electrode protrudes from an inner surface of the corresponding end cap in a longitudinally inward direction of the ceramic tube. The end caps are covered at their inner surfaces with corresponding electrical insulators, at least one of which has a protruding portion surrounding a part of the corresponding electrode protruding from a radially central part of the inner surface of the corresponding end cap. The surrounded part of the corresponding electrode is radially spaced a predetermined distance from the protruding portion of the electrical insulator.

In the ceramic envelope for the high-pressure discharge lamp constructed as described above, the electrical insulator covering the inner surface of the corresponding end cap will effectively protect the ceramic envelope device against the "arc-back" phenomenon at the moment when the lamp is turned on. That is, the electrical insulator will serve to protect the end cap against damage due to such "arc-back" phenomenon, thus contributing to improvement in the operating reliability of the lamp. Furthermore, the prevention of the "arc-back" trouble by the electrical insulator results in solving the conventionally experienced problem of blackening of the inner surface of the translucent ceramic tube, thereby maintaining a high degree of luminous flux of the translucent ceramic tube.

More specifically, the protruding portion of the electrical insulator keeps the liquid phase of metal halide, (of the metal halide lamp) which may be condensed near the end cap, away from the exposed end portion of the heated discharging electrode. At the same time, the predetermined distance between the electrode and the corresponding electrical insulator protects the liquid metal halide against thermal conduction of the high-temperature electrode. As a result, the reactivity of the liquid metal halide is inhibited. The central portion of the end cap around the fixed end of the electrode is also protected by the protruding portion of the electrical insulator, against corrosion due to the liquid metal halide. Hence, the instant ceramic tube overcomes the conventional failure of the end cap to stably support the electrode.

In accordance with one embodiment of the invention, the electrical insulator is made of a refractory ceramic material selected from the group consisting of alumina, beryllia, spinel, boron nitride and glass frit. It is recommended that the electrical insulator is made of white and opaque alumina.

According to another embodiment of the invention, the electrical insulator has an annular peripheral portion of a constant thickness, as measured from the inner surface of the corresponding end cap. In this case, the thickness of the annular peripheral portion is preferably held within a range of 0.05–0.8 mm.

According to a further embodiment of the invention, the electrical insulator has a protruding portion which is positioned at a radially central part of the corresponding end cap and which is of tubular shape having a central bore through which the corresponding electrode extends. The thickness of the protruding portion is held preferably within a range of 1.0–3 mm, as measured from the inner surface of the corresponding end cap. The protruding portion may have a variable-diameter part, wherein the diameter decreases as it protrudes from the inner surface of the end cap. The electrical insulator may have a secondary protruding portion which contacts the central part of the corresponding end cap and protrudes from the inner surface of the protruding portion into the central bore. The secondary protruding portion is radially spaced apart from the corresponding electrode.

According to yet a further embodiment, the electrical insulator is of frusto-conical shape having a central bore through which the corresponding elecrode extends with a radial gap therebetween.

In another embodiment of the invention, the predetermined distance between the electrode and the corresponding electrical insulator is held not more than a half of a radius of the end cap, more preferably within a range of 0.1–2 mm.

BRIEF DESCRIPTION OF THE DRAWINGS

The features and advantages of the invention will be apparent from reading the following description of illustrative embodiments taken in conjunction with the accompanying drawings, in which.

DETAILED DESCRIPTION OF THE PREFERRED EMBODIMENTS

To further clarify the present invention, preferred embodiments of the invention will be described in detail with reference to the accompanying drawings.

Figure 1:
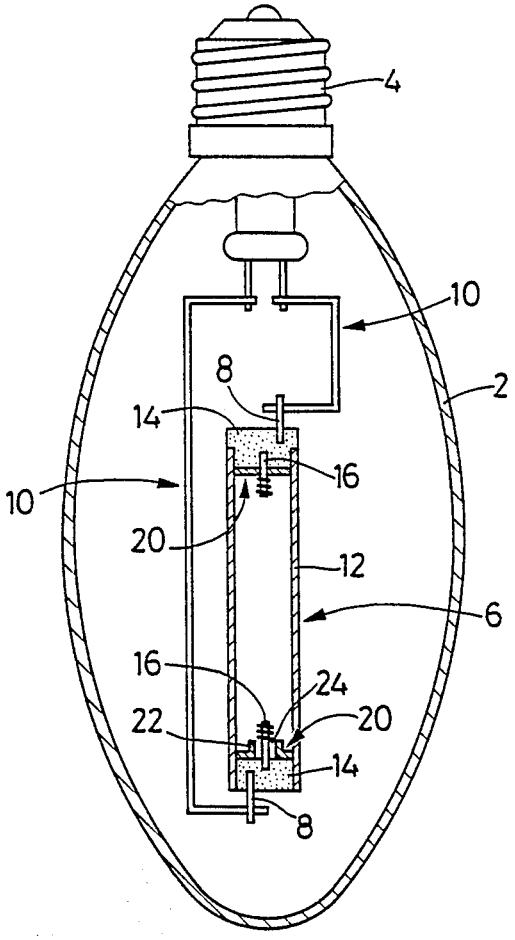
FIG. 1 is a schematic elevational view partly in cross section of an HID lamp incorporating one embodiment of a ceramic envelope device of the invention which includes a translucent ceramic tube and end caps closing the opposite ends of the tube.

FIG. 1 schematically illustrates a complete assembly of a HID lamp which incorporates one preferred embodiment of a ceramic envelope device 6 of the invention which will be described. In the figure, reference numeral 2 designates a bulbiform translucent jacket which is generally made of glass or a similar material. This translucent jacket 2 is closed at its open end by a base 4. The jacket 2 and the base 4 cooperate to form a gas-tight enclosure which is charged with a suitable inert gas such as nitrogen, or maintained under vacuum. As is well known in the art, electric power applied to the base 4 is supplied, via electrical conductor members 10, to electrically conducting lead members in the form of electrical contact rods 8, which are disposed at the opposite ends of the ceramic envelope device 6 accommodated in the translucent jacket 2.

The ceramic envelope device 6 includes a translucent ceramic arc tube 12 and a pair of closure discs in the form of end caps 14, which are secured to the opposite ends of the ceramic arc tube 12 such that the end caps 14, close the opposite ends of the arc tube 12 so as to maintain a gas-tight ceramic envelope 6. The translucent ceramic arc tube 12 is a tubular member made of alumina or other ceramic materials as disclosed in U.S. Pat. Nos. 3,026,210 and 3,792,142. The end caps 14 are formed of an electrically conducting cermet. The ceramic arc tube 12 of the gas-tight ceramic envelope device 6 is charged with a suitable gas and suitable metal or its compound, which is selected depending upon the specific type of the HID lamp, from the standpoints of radiant efficiency, color-rendering properties, etc. In the case of a high-pressure sodium lamp, for example, the arc tube 12 is charged with metallic sodium, mercury and rare gas. In a metal halide lamp, the arc tube 12 is charged with metal halide (such as dysprosium iodide, thallium iodide, sodium iodide, indium iodide, etc.), together with mercury and rare gas.

The subject matter of the invention is particularly related to the electrically conducting end caps 14, which serve as closure members for the translucent arc tube 12.

Figure 2:
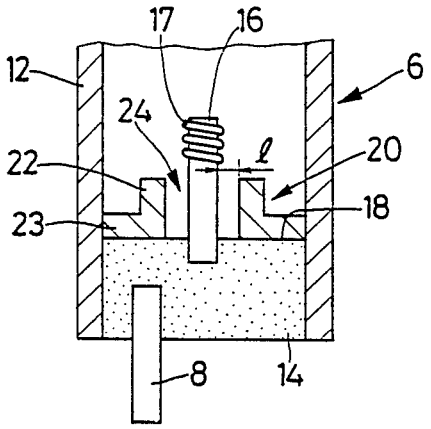
FIG. 2 is a fragmentary view partly in cross section, showing in enlargement one end portion of the envelope device of the HID lamp of FIG. 1.

As illustrated in FIG. 2 on an enlarged scale, an electrically conducting end cap 14 is fitted in one end of a translucent ceramic arc tube 12, by shrinkage differential between the end cap 14 and the arc tube 12 during a sintering process. The contact rod 8 is embedded at its one end in the outer portion of the end cap 14, such that the other end of the rod 8 protrudes outwardly from the outer surface of the end cap 14. In the meantime, a known electrode 16 of tungsten or some other metal is similarly embedded at its one end in the inner portion of the end cap 14, such that the other end of the electrode 16 protrudes from an inner surface 18 of the end cap 14 in a longitudinally inward direction of the translucent arc tube 12. The electrode 16 is positioned at a radially central portion of the end cap 14.

The inner surface 18 from which the electrode 16 protrudes is covered with an electrical insulator 20, except the central portion thereof around the fixed end of the electrode 16. In this embodiment, at least the electrical insulator 20 for the lower end cap 14 (the lower insulator when the lamp is oriented upright as shown in FIG. 1) has a central protruding portion 22 of tubular shape, which protrudes longitudinally inward of the ceramic arc tube 12. The protruding portion of the electrical insulator surrounds a longitudinally intermediate part of the centrally located discharge electrode 16, which protrudes from the inner surface 18 of the corresponding (lower) end cap 14. Stated more specifically, the central protruding portion 22 protrudes from an annular peripheral portion 23 of the electrical insulator 20 and has a thickness larger than that of the peripheral portion 23 as measured from the inner surface 18 of the end cap 14. The discharge electrode 16, which is embedded over a suitable length in the central portion of the corresponding end cap 14, extends through a central bore 24 defined by the protruding portion. The discharge electrode is spaced a predetermined distance from the protruding portion 22 (the electrical insulator 20) in the radial direction of the electrode.

In the ceramic envelope device 6 described above, the electrical insulator 20 which has the central protruding portion 22 provided therein with the central bore 24 and covers the inner surface 18 of the end cap 14, is effective to prevent an "arc-back" phenomenon which is an electrical discharge between the electrode 16 and the inner surface 18 upon application of a voltage between the opposed electrodes 16, through the contact rods 8, at the moment when the HID lamp is turned on.

Therefore, the electrical insulators 20, 20 permit normal arcing between the opposed ends of the discharge electrodes 16, 16, making it possible to prevent the conventionally experienced troubles of cracking and consequent leaking at the end caps 14, due to the "arc-back" phenomenon, and to avoid vaporization and scattering of refractory metal of the cermet end caps 14. Accordingly, the electrical insulators 20, are capable of solving the conventionally encountered problem of blackening of the inner surface of the translucent arc tube 12 due to deposition of the refractory metal component of the end cap, thereby overcoming the resulting problem of reduced luminous flux of the arc tube 12.

Moreover, when the lamp is on, the central bore 24 (more strictly, the predetermined radial distance between the electrode 16 and the inner or bore-defining surface of the protruding portion 22 of the electrical insulator 20) effectively cuts off thermal conduction of the heated electrode 16, so as to keep at a comparatively low temperature the liquid phase of supersaturated metal halide condensed around the inner surface of the peripheral portion 23 of the electrical insulator 20, thereby inhibiting the reactivity of the liquid metal halide. The liquid metal halide around the central bore 24 is gasified due to the high-temperature electrode 16 and the gasified metal halide is condensed in the cold spot spaced from the electrode 16, i.e., the peripheral portion of the ceramic arc tube 12. As a result, the central portions of both the end cap 14 and the electrical insulator 20 around the electrode 16 are advantageously protected against corrosion by the liquid metal halide. Hence, the durability of the lamps is increased.

Furthermore, the central protruding portion 22 of the electrical insulator 20 keeps the liquid phase of metal halide condensed in the vicinity of the end cap 14 away from the exposed end portion of the discharge electrode 16. Thus the central portion of the cermet end cap 14 around the fixed end of the electrode 16 is protected against exposure to the liquid metal halide and consequent corrosion thereof. Hence, the conventional failure of the end cap 14 to stably support the electrode 16 is effectively avoided.

The thermal-expansion properties of the electrical insulator 20 (e.g., alumina) may not match that of the electrode 16 (e.g., tungsten, molybdenum). The presence of the predetermined distance between the electrode 16 and the inner surface of the protruding portion 22 prevents the electrical insulator 20 from suffering cracking or similar problems due to thermal expansion differences, when the lamp, more specifically the envelope device, is manufactured.

The electrically conducting end caps 14, closing the translucent ceramic arc tube 12 of the ceramic envelope device 6 are formed of suitable known electrically conducting materials having a coefficient of thermal expansion which is intermediate between that of the material of the translucent ceramic arc tube 12 and that of the refractory metal of the electrodes 16 and contact rods 8. For example, a composite material of metallic tungsten or molybdenum and aluminum oxide, or tungsten carbide, or tungsten boride may be suitably used for the end caps 14. In particular, it is recommended to use a cermet which is a composite material of a non-metallic material and a metal and is variable in refractoriness (heat resistance), corrosion resistance, thermal expansion coefficient and electric resistance by changing its composition. Preferably, the cermet consists of 8–50% by weight of refractory metal such as tungsten or molybdenum, and the balance being aluminum oxide. The cermet containing not more than 8% by weight of a metallic material is excessively high in electrical resistance, while the cermet containing a metallic material in an amount exceeding 50% by weight can not be a sufficiently densified body, and renders the end caps 14, poor in gastightness.

The electrical insulators 20, provided to cover the inner surfaces 18, of the end caps 14, on the side of the electrodes 16, are made of known suitable electrically insulating materials, preferably refractory and electrically insulating ceramics having a thermal expansion coefficient close to that of the material of the end caps 14. For example the electrical insulators 20, are made of alumina, beryllia, spinel, boron nitride, or glass frit. In particular, it is recommended to use white and opaque alumina, because the material advantageously reflects radiant heat from the electrodes 16, and thereby keeps the liquid phase of supersaturated metal halide at a lower temperature than other materials. These insulators 20, are formed in a suitable one of known processes. For instance, they are molded and sintered simultaneously as an integral part of the end caps 14, or separately from the end caps 14. They may be formed by applying a coating of a selected insulating material to the pre-sintered material of the end caps 14, by using a glass-frit sealing layer.

Figure 3:
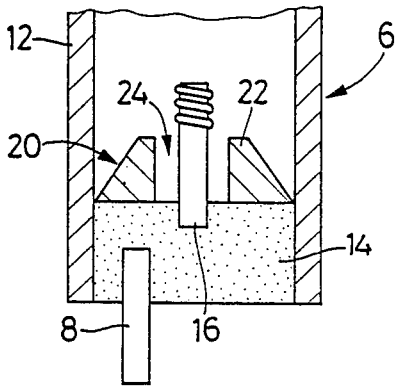
FIGS. 3–5 are views corresponding to FIG. 2, illustrating modified embodiments of the invention.

In accordance with the present invention, it is essential that the electrical insulator 20 be formed with a protruding portion (22) protruding along a longitudinal axis of the electrode 16 and surrounding a part of the electrode 16. Therefore, although the central protruding portion 22 of the illustrated embodiment of FIG. 2 is provided as a stepped portion which protrudes from the annular peripheral portion 23 of the electrical insulator 20, it is possible that the electrical insulator 20 be formed as shown in FIG. 3, such that the protruding portion 22 has a variable-diameter part which has a thickness increasing in a radially inward direction toward the central bore 24, as measured from the inner surface 18 of the end cap 14. In other words, the diameter of the variable-diameter part of the protruding portion 22 decreases as it protrudes from the inner surface 18.

While at least the inner surface 18 of each end cap 14 must be covered with the electrical insulator 20 according to the invention, it is possible to cover all surfaces of the end cap 14 with the electrical insulator 20. The thickness of the peripheral portion 23 of the electrical insulator 20 of FIG. 2 is selected within an appropriate range so as to effectively restrain the "arc-back" phenomenon, generally within an approximate range of 0.05–0.8 mm. The thickness of the central protruding portion 22 surrounding the longitudinally intermediate part of the electrode 16 is determined to fall within a range of 1.0–3 mm, in order to protect the exposed portion of the electrode 16 against exposure to the con densed metal halide, thereby protecting the central portion of the end cap 14 around the fixed end of the electrode 16. However, the thickness of the central protruding portion 22 should be determined so that the top of the protruding portion 22 will not contact a coil 17 wound on the exposed portion of the electrode 16.

The diameter of the central bore 24 is selected so that the electrode 16 and the protruding portion 22 of the electrical insulator 20 do not contact each other. To this end, the distance l between the two members is determined to be not more than ½ the radius of the end cap 14, more preferably, approximately within 0.1–2 mm.

Figure 4:
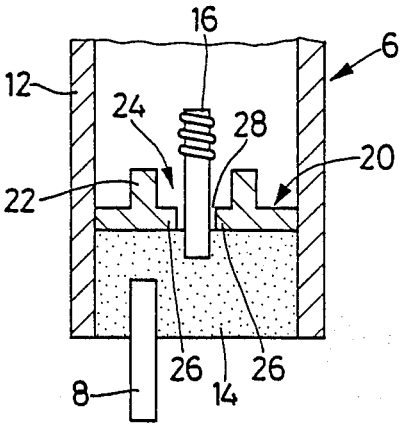

Another embodiment of the invention is illustrated in FIG. 4. The central bore 24 defined by the protruding portion 22 of the electrical insulator 20 avoids more effectively the arc-back phenomenon if the insulator 20 is provided with a secondary protruding portion 26. The secondary protruding portion 26 contacts an annular central part of the corresponding end cap 14 and protrudes from a part of the inner surface of the protruding portion 22 (the electrical insulator 20) into the central bore 24. In this case, the secondary protruding portion 26 defines a secondary central bore 28 and is radially spaced a shorter distance from the corresponding electrode 16 than the distance l.

The closure end caps 14, covered with the electrical insulators 20, which have been described hitherto, are suitably applicable to the translucent ceramic tube 12 used in HID lamps such as high pressure sodium lamps and metal halide lamps. Above all, they are preferably used for the metal halide lamps in accordance with the present invention.

Figure 5:
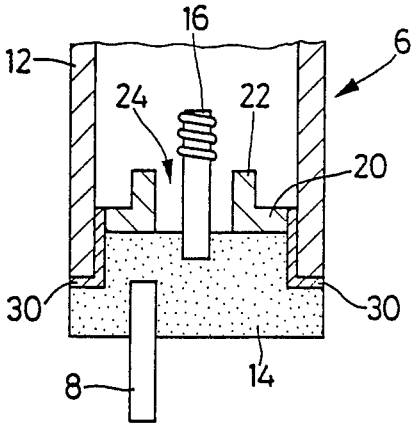

While the end caps 14 of FIGS. 2, 3 and 4 are secured to the ceramic arc tube 12 by utilizing a shrinkage differencial between the two members during a sintering process, it will be obvious that the end cap 14 may be fixed to the ceramic tube 12 with the help of a sealing layer 30 of glass frit, for example, as illustrated in FIG. 5.

While the present invention has been illustrated in its preferred embodiments, it is to be understood that the invention is not limited by the details of description of construction and arrangement, and that it is intended to cover all changes, modifications and improvements which are obvious to those skilled in the art, and which do not affect the spirit of the invention nor exceed the scope thereof as expressed in the appended claims.

What is claimed is:

1. A ceramic envelope device for a high-pressure metal vapor discharge lamp comprising:

a translucent ceramic tube having a first end and a second end and an inner peripheral surface and an outer peripheral surface;

a first electrically conducting cermet end cap having an inner surface and an outer surface, said first electrically conducting cermet end cap closing said first end of the ceramic tube;

a second electrically conducting cermet end cap having an inner surface and an outer surface, said second electrically conducting cermet end cap closing said second end of the ceramic tube;

a first discharge electrode having an inner end and an outer end and an outer peripheral surface, said outer end of the first discharge electrode being inserted into said inner surface of said first end cap such that said inner end of the first discharge electrode protrudes from the inner surface of the first end cap longitudinally into the ceramic tube;

a second discharge electrode having an inner end and an outer end and an outer surface, said outer end of the second discharge electrode being inserted into said inner surface of said second end cap such that said inner end of the second discharge electrode protrudes from the inner surface of the second end cap longitudinally into the ceramic tube;

a pair of electrically insulating members, each electrically insulating member having an outer surface which contacts said inner surface of the first and second electrically conducting end caps, respectively, at least one of said pair of electrically insulating members having an inner protruding portion which protrudes longitudinally into the ceramic tube, said inner protruding portion creating a radial gap between said inner peripheral surface of the ceramic tube and said protruding portion and also creating a predetermined radial gap between said protruding portion and a corresponding outer surface of at least one of said first and second discharge electrodes, wherein a corresponding inner surface of at least one of said first and second end caps does not extend longitudinally into said ceramic tube beyond said outer surface of the corresponding electrically insulating member.

2. A ceramic envelope device as claimed in claim 1, wherein said first and second electrically insulating members comprise a refractory ceramic material selected from the group consisting of alumina, beryllia, spinel, boron nitride, and glass frit.

3. A ceramic envelope device as claimed in claim 2, wherein said first and second electrically insulating members comprise white and opaque alumina.

4. A ceramic envelope device as claimed in claim 1, wherein said inner protruding portion of said at least one of said pair of electrically insulating members protrudes from an annular portion having a constant thickness in the longitudinal direction of the ceramic tube.

5. A ceramic envelope device as claimed in claim 4, wherein said annular portion has a thickness of 0.05–0.8 mm, in the longitudinal direction as measured from the inner surface of the corresponding end cap.

6. A ceramic envelope device as claimed in claim 1, wherein said protruding portion is positioned at a radially central part of the corresponding end cap, and comprises a tubular shape having a central bore through which the corresponding discharge electrode longitudinally extends.

7. A ceramic envelope device as claimed in claim 6, wherein said protruding portion has a longitudinal height of 1.0–3 mm, as measured from the inner surface of the corresponding end cap.

8. A ceramic envelope device as claimed in claim 6, wherein said protruding portion has a variable transverse thickness which decreases longitudinally inwardly.

9. A ceramic envelope device as claimed in claim 1, wherein said at least one of said pair of electrically insulating members comprises a substantially frustoconical shape having a central bore through which the corresponding discharge electrode protrudes.

10. A ceramic envelope device as claimed in claim 1, wherein said predetermined radial gap is not more than a half of a radius of said end caps.

11. A ceramic envelope device as claimed in claim 10, wherein said predetermined radial gap is held within the range of 0.1–2 mm.

12. A ceramic envelope device as claimed in claim 6, wherein said at least one of said pair of electrically insulating members has a secondary protruding portion which contacts a central part of the corresponding end cap and protrudes from a part of the inner surface of said central bore of said at least one electrically insulating member into said central bore, said secondary protruding portion being radially spaced from the corresponding electrode.

* * * * *